United States Patent [19]

Doolin

[11] Patent Number: 4,494,958

[45] Date of Patent: Jan. 22, 1985

[54] BLENDING ASPHALTITE WITH LIGNITE OR BITUMINOUS COAL

[76] Inventor: Thomas J. Doolin, 321 W. Sanner St., Somerset, Pa. 15501

[21] Appl. No.: 519,703

[22] Filed: Aug. 2, 1983

[51] Int. Cl.[3] ..... C10L 9/10

[52] U.S. Cl. ..... 44/1 G; 44/10 D

[58] Field of Search ..... 44/1 G, 10 D, 23

[56] References Cited

U.S. PATENT DOCUMENTS

| | | | |
|---|---|---|---|
| 103,580 | 5/1870 | DeSmedt | 44/23 |
| 329,514 | 6/1907 | Jordan | 44/23 |
| 1,603,961 | 10/1926 | Liais | 44/23 |

*Primary Examiner*—Carl F. Dees

*Attorney, Agent, or Firm*—Bernard, Rothwell & Brown

[57] ABSTRACT

The use of asphaltite blended with bituminous coals and lignites changes the agglomeration properties and quality of the resultant mixture to a degree and extent disproportionate to the blend.

4 Claims, No Drawings

BLENDING ASPHALTITE WITH LIGNITE OR BITUMINOUS COAL

BACKGROUND OF THE INVENTION

1. Field of the Invention

This invention relates to an improved mixture or blend of solid carbonaceous materials, and particularly to a blend of asphaltite with bituminous coals or lignite.

2. Prior Art

There is a material available in nature, usually obtainable by mining, which is known as asphaltite. This material is not classified as coal, although it has been referred to as "oil bearing coal." Asphaltite is instead solidified petroleum composed of 25–75% fixed carbon which resulted from the progressive loss of the volatile constituents contained in the bitumen. Grahamite which occurs in Pushmataha County, Okla., is a general type of asphaltite. It is characterized as having 30–55% fixed carbon; also, it is fusible and soluble in carbon disulfide. Solubility in carbon disulfide is the criterion that separates asphaltites from coals. Grahamite from the Pushmataha mines has been used for various purposes such as; manufacturing roofing, waterproofing compounds, candles, ointments, powders, beeswax, paints, varnishes, lining for chemicals tanks, roofing pitch, insulation for electric wires, garden hoses, binder for pitch in making coal briquettes, rubber substitutes, filler for brick and stone blocks, and molded insulation. The grahamite mined in Oklahoma and Arkansas is generally representative of similar low volatile coals such as albertite and impsonite found in Virginia, West Virginia and Pennsylvania.

At present however, asphaltite is not often used in coking processes because it burns too hot and burns out grates. This problem could be cured by utilizing water-cooled grates, but such equipment is expensive and is usually not installed merely to facilitate the burning of asphaltite. There are various other bituminous materials that have a certain heat content, but also have drawbacks that limit their use. For example, when North Dakota Lignite is ground up, the fines or dust below 28 mesh are removed. This material does not have a significant use unless the expensive process of pelletizing or agglomerating the fines is carried out. There are also eastern bituminous coals, for example, low volatile metallurgical coals, which are presently unsaleable because of their lack of volatile matter.

Lignite itself has a free swelling index (FSI) of 0, which means that it is substantially nonagglomerating and not useful at all for coke.

SUMMARY OF THE INVENTION

This invention contemplates blending asphaltite with lignite or bituminous coal to produce a composition which has better agglomerating characteristics and a higher heat content (BTU) than would be expected from a straight mixture. In other words, by mixing and blending asphaltite and lignite or bituminous coal the agglomerating characteristics and heat content of the resulting mixture are increased in a synergistic manner. That is, they are increased more than would be expected by a calculation of the percentages based on FSI or BTU of the individual constituents of the blend.

DETAILED DESCRIPTION OF THE PREFERRED EMBODIMENT

In a preferred emodiment asphaltite (asphaltite) having an analysis as set forth below is blended with lignite:

| | As Received | Dry | Dry Ash-Free |
|---|---|---|---|
| Moisture | 1.7 | | |
| Ash | 3.04 | 3.09 | |
| Volatile | 41.89 | 42.61 | 43.97 |
| Fixed Carbon | 53.37 | 54.30 | 56.03 |
| | 100.00 | 100.00 | 100.00 |
| Sulfur | 1.52 | 1.54 | |
| BTU | 15682 | 15953 | 16462 |
| FSI 9.0 | | | |

The lignite incorporated in the blend has the following analysis:

| | Residual Moisture 13.31 | | |
|---|---|---|---|
| Air Dry Loss 34.44 | As Received | Dry | Dry Ash-free |
| PROXIMATE ANALYSIS | | | |
| Moisture | 43.16 | | |
| Ash | 5.64 | 9.91 | |
| Volative Matter | 24.69 | 43.43 | 48.21 |
| Fixed Carbon | 26.51 | 46.66 | 51.79 |
| | 100.00 | 100.00 | 100.00 |
| ULTIMATE ANALYSIS | | | |
| Hydrogen | 7.32 | 4.38 | 4.86 |
| Carbon | 36.89 | 64.91 | 72.05 |
| Nitrogen | 0.64 | 1.13 | 1.25 |
| Sulfur | 0.45 | 0.79 | 0.88 |
| Oxygen | 49.06 | 18.88 | 20.96 |
| Ash | 5.64 | 9.91 | |
| | 100.00 | 100.00 | 100.00 |
| HEATING VALUE (BTU/LB) | 6145 | 10811 | 12001 |
| FORMS OF SULFUR | | | |
| Sulfate sulfur | 0.02 | 0.04 | 0.04 |
| Pyritic sulfur | 0.09 | 0.15 | 0.17 |
| Organic sulfur | 0.34 | 0.60 | 0.67 |
| FREE SWELLING INDEX 0.0 | | | |
| ASH FUSION TEMPERATURES (Reducing Atmosphere) | | | |
| Initial Deformation | 2270 F. | | |
| Softening Temp. | 2300 F. | | |
| Fluid Temp. | 2310 F. | | |

The resulting blend samples of 50% lignite and 50% asphaltite is found to have the following analysis:

| | As Received | Dry | Dry Ash-Free |
|---|---|---|---|
| Moisture | 1.0 | | |
| Ash | 8.61 | 8.69 | |
| Volatile | 42.71 | 43.14 | 47.24 |
| Fixed Carbon | 47.68 | 48.17 | 52.76 |
| | 100.00 | 100.00 | 100.00 |
| Sulfur | 1.40 | 1.42 | |
| BTU | 13209 | 13343 | 14613 |
| FSI 8.5 | | | |

It can thus be seen that by taking lignite having a free-swelling index of 0 and blending it in 50–50 mixture with asphaltite having a FSI of 9, one would expect on a mathematical basis a resulting FSI of 4.5. However, as shown by the analysis, the FSI or agglomerating properties are significantly increased so that the blend may be used for coking.

Also, considering the heat value or BTU, it can be seen that the as received blend of lignite and asphaltite is 13,209, while the BTU per pound of the lignite alone is 6,145 and the BTU of the asphaltite alone is 15,682, which on a 50–50 blend basis would calculate to give a resultant BTU value of 10,913, whereas the test shows that the resulting BTU value is surprisingly and unexpectedly 13,209.

Other blends of lignite and asphaltite were made and analyzed with the results that a 40% blend of lignite and 60% of asphaltite yields an FSI of 9, while 20 and 40% asphaltite to 80 and 60% lignite yield FSIs of 3 and 5.5 which are below the acceptable minimum for coking coal.

It has also been found that the combination of 60% asphaltite with 40% Somerset low volatile metallurgical coal

| | As Received | Dry | Dry Ash-Free |
|---|---|---|---|
| Moisture | 1.0 | | |
| Ash | 5.13 | 5.18 | |
| Volatile | 32.66 | 32.99 | 34.80 |
| Fixed Carbon | 61.21 | 61.83 | 65.20 |
| | 100.00 | 100.00 | 100.00 |

-continued

| | As Received | Dry | Dry Ash-Free |
|---|---|---|---|
| Sulfur | 1.27 | 1.28 | |
| BTU | 15122 | 15275 | 16110 |
| FSI 9.0 | | | |

This mixture increased the volatile content of the coals significantly so that it would be more saleable and also synergistically increased the heat content or BTU value more than would be expected from a strict mathematical calculation based on the BTU value of the two constituents of the blend.

The reason that the agglomerating characteristic and heat values of the blends are increased in such a synergistic manner is not known at present and at present Applicant cannot even speculate on the reason.

I claim:

1. A composition comprising a blend mixture of particles of asphaltite and lignite or bituminous coal in which the asphaltite is at least 50% by weight of the mixture.

2. A composition as in claim 1 in which the asphaltite is blended with lignite on a 50–50 basis.

3. A composition as in claim 1 wherein the asphaltite is blended with low volatile metallurgical coal.

4. A composition as in claim 3 wherein the asphaltite is blended with low volatile metallurgical coal on a 60–40 basis.

* * * * *

UNITED STATES PATENT AND TRADEMARK OFFICE

CERTIFICATE OF CORRECTION

PATENT NO. : 4,494,958

DATED : January 22, 1985

INVENTOR(S) : Thomas J. Doolin

It is certified that error appears in the above-identified patent and that said Letters Patent is hereby corrected as shown below:

Column 3, line 20, after "coal" insert -- produced a mixture as shown in the following table --.

Signed and Sealed this

*Twenty-seventh* Day of *August 1985*

[SEAL]

*Attest:*

DONALD J. QUIGG

*Attesting Officer*

*Acting Commissioner of Patents and Trademarks*